US005412284A

United States Patent [19]

Moore et al.

[11] Patent Number: 5,412,284

[45] Date of Patent: May 2, 1995

[54] TWO PHOTOCELL CONTROLLED LIGHTING SYSTEM EMPLOYING FILTERS FOR THE TWO PHOTOCELLS THAT CONTROL ON/OFF OPERATION FOR THE SYSTEM

[76] Inventors: Martha H. Moore, 1102 Claire, Austin, Tex. 78703; Robbie C. Koenig, 1000 S. Danville Rd. Stonebridge Apartment #618, Kilgore, Tex. 75662

[21] Appl. No.: 304,596

[22] Filed: Sep. 12, 1994

Related U.S. Application Data

[63] Continuation of Ser. No. 857,325, Mar. 25, 1992, abandoned.

[51] Int. Cl.[6] ..... H05A 33/00

[52] U.S. Cl. ..... 315/155; 315/159; 315/324; 362/800

[58] Field of Search ..... 315/155, 159, 185 S, 315/324; 359/142, 147; 362/123, 252, 227, 396, 800, 806; 250/206; 307/11, 38, 40, 117, 157

[56] References Cited

U.S. PATENT DOCUMENTS 2,827,594 3/1958 Rabinow ..... 315/155
4,866,580 9/1989 Blackerby ..... 362/800

*Primary Examiner*—Robert J. Pascal
*Assistant Examiner*—Michael B. Shingleton
*Attorney, Agent, or Firm*—David H. Judson

[57] ABSTRACT

A cordless lighting system for a Christmas tree comprising a control transmitter for generating light signals of first and second frequencies, and a plurality of light elements adapted to be supported on the Christmas tree. Each of the light elements comprises a light source for generating visible light, a battery for supplying power to activate the light source, a bistable switch having an input, and an output connected to the light source, and first and second photocells responsive to light signals of the first and second frequencies, respectively, for generating first and second control signals to the input of the bistable switch. The first control signal controls the bistable switch to activate the light element and the second control signal controls the bistable switch to deactivate the light element. Preferably, the light elements activate each other in a cascade fashion.

7 Claims, 2 Drawing Sheets

TWO PHOTOCELL CONTROLLED LIGHTING SYSTEM EMPLOYING FILTERS FOR THE TWO PHOTOCELLS THAT CONTROL ON/OFF OPERATION FOR THE SYSTEM

This is a continuation of application Ser. No. 07/857,325 filed on Mar. 25, 1992, now abandoned.

TECHNICAL FIELD

The present invention relates generally to lighting and more particularly to a cordless lighting system for use especially with a Christmas tree or other decorative object or fixture.

BACKGROUND OF THE INVENTION

Ornamental light systems for trees and other seasonal decorative objects are well-known in the prior art. For example, such systems are commonly used to light Christmas trees and include a plurality of light elements supported along an electrical cord. Cords are aesthetically displeasing and are an inconvenience to untangle and set up, and they limit the user's ability to selectively place the lights. Such limitations usually prevent use of prior lighting systems on hard-to-reach locations (e.g., a high balcony or roof). Furthermore, the cords of such lighting systems are a potential safety hazard. Also, children or their pets can become tangled in the light cords on the Christmas tree, causing the whole tree to fall. This can damage precious ornaments and possibly injure the child or pet.

There are numerous other problems with such prior art systems. When one light bulb on a string of lights goes out, it is usually difficult to replace the faulty light, and thus an entire new string of lights must be purchased. Also, plug outlet restrictions often limit the number of lights that can be put on a Christmas tree. Currently available tree lighting systems are inefficient, are not durable, and often exhibit consistent faults after just a few seasons of use.

Cordless Christmas tree lighting systems have been proposed. U.S. Pat. No. 2,525,624 discloses one such system wherein the individual gas-filled bulbs are selectively positioned on an artificial tree and are energized using a high frequency electric field generator that causes the bulbs to glow. U.S. Pat. No. 2,822,508 also discloses a cordless Christmas tree light; system that uses an oscillating electrical energy source that transmits electrical energy toward a number of gaseous glow lamps. While such systems theoretically overcome the problems of cord-based tree lighting systems, they are impractical, costly, unreliable, and intended for use only with artificial trees. More recently, others have attempted to solve the long felt need for cordless Christmas tree lighting systems by creating complex systems in artificial trees. One such system is shown in U.S. Pat. No. 4,855,880. This solution obviously is unacceptable to those who desire a natural tree.

There is therefore a need to provide an improved cordless lighting system for use, for example, to decorate a Christmas tree or other decorative object.

BRIEF SUMMARY OF THE INVENTION

It is an object of the present invention to provide a lighting system that is cordless, that uses individual rechargeable lighting elements, that can be remotely controlled, and that provides aesthetically-pleasing lighting effects. Preferably the lighting system is used in conjunction with a natural tree.

It is a further object of the invention to provide such a cordless lighting system that is particularly adapted for use with a Christmas tree.

It is a further object to provide a cordless Christmas tree lighting system that is simple and safe to store, install, and use, and that provides an aesthetically pleasing decorative effect.

It is still another object of the invention to provide a cordless Christmas tree lighting system wherein the individual light elements of the systems are small and easy to position, replace and repair.

These and other objects of the invention are provided in one embodiment of a cordless lighting system for a Christmas tree comprising a control transmitter for generating light signals of first and second frequencies, and a plurality of light elements adapted to be supported on the Christmas tree. Each of the light elements comprises a light source for generating visible light, a battery for supplying power to activate the light source, a bistable switch having an input, and an output connected to the light source, and first and second photocells responsive to light signals of the first and second frequencies, respectively, for generating first and second control signals to the input of the bistable switch. The first control signal controls the bistable switch to activate the light element and the second control signal controls the bistable switch to deactivate the light element. Preferably, the light elements activate each other in a cascade fashion.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

The following discussion is directed to a cordless lighting system for use especially with a Christmas tree. It should be appreciated, however, that such description is exemplary only and is not to be taken by way of limitation. The cordless lighting system of the invention is considered useful in providing decorative lighting for numerous other types of decorative objects or fixtures.

Figure 1:
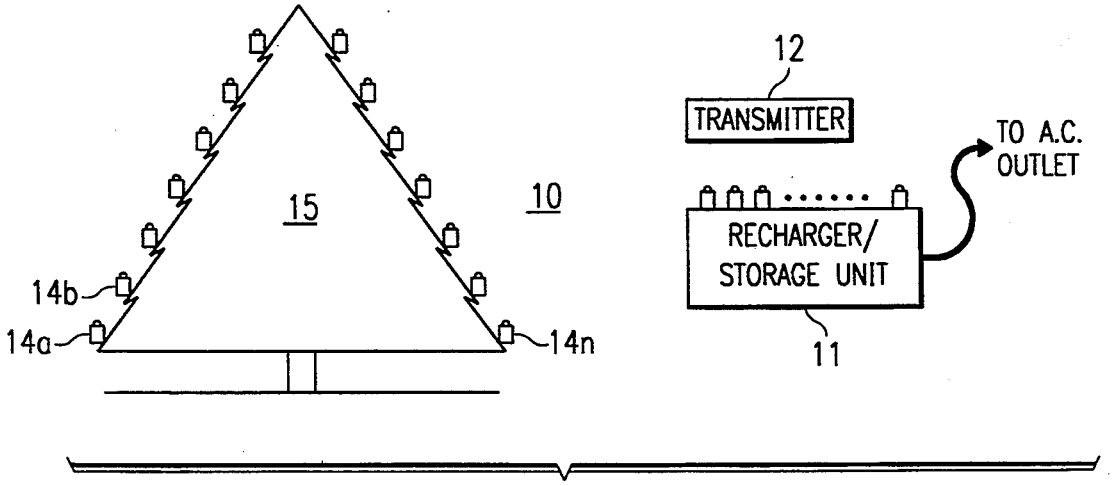
FIG. 1 is a block diagram of the basic elements of the cordless tree lighting system of the present invention.

As seen in FIG. 1, the cordless lighting system 10 comprises a control transmitter 12 and a plurality of light elements 14*a*–14*n*. As will be described, each of the individual light elements includes a battery, a light sensor circuit, and a suitable light source such as an light emitting diode or ("LED"). Each of the individual light elements is selectively positionable on the tree 15 using a clamp. Thus, instead of using an electrical cord to supply energy to light the individual elements, the system 10 advantageously uses a remote control transmitter to activate the lights. Preferably, the transmitter requires only a low power output because the individual light elements are designed to turn themselves on in a "cascade" effect as will be described.

Figure 2:
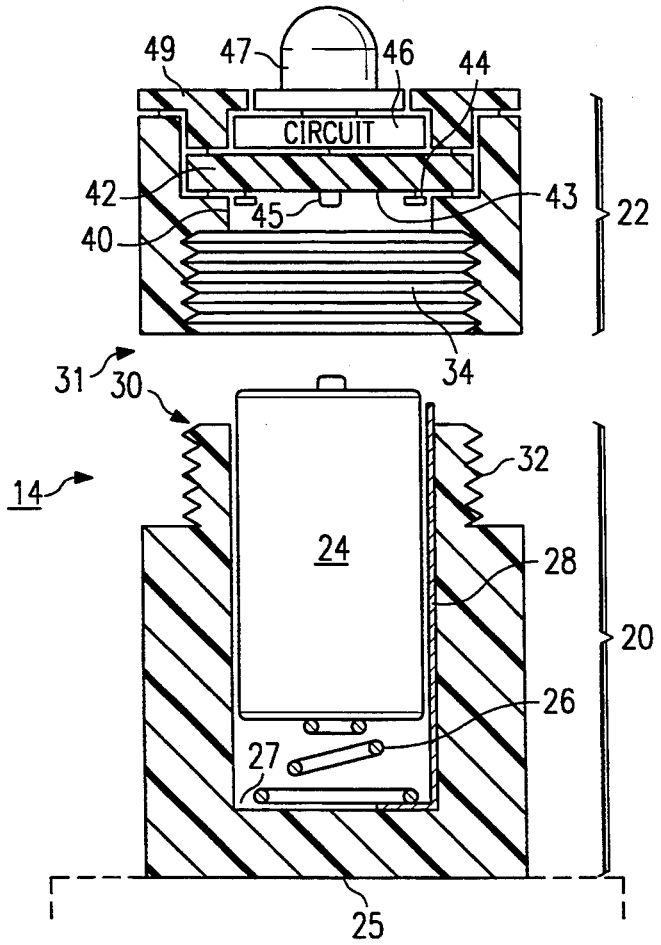
FIG. 2 is an elevation view of one of the light elements for use in the cordless tree lighting system of FIG. 1.

Referring now to FIG. 2, an elevation view is shown of one of the light elements 14 of FIG. 1. Light element 14 is shown here without any decorative covering although it should be appreciated that the element will likely be supported in a simulative "candle" having a collection dish. The candle and dish are formed of polyvinyl chloride (PVC) because of its good combination of strength, toughness, manufacturability, and cost.

The light element 14 comprises a bottom casing 20 and a lid 22 that are threaded together to form a closed unit. In particular, casing 20 is essentially a hollow cylinder open on one end. It supports a battery 24, a spring 26, and a wire 28 running from bottom to top along the side of the hollow cylinder. The spring 26 is not attached to the casing, but rests loosely at the base 27 of the battery compartment. The spring insures that good electrical contact is made between the battery and the contact on the bottom of the lid. The spring exerts an upward force on the battery when the lid is removed so that the battery is accessible for removal. The bottom surface 25 of the casing 20 can be fitted to a simulated candle dish. The top 30 of the casing 20 includes a threaded portion 32. The lid 22 includes an internal threaded portion 34 at its lower end 31, and the threaded portions 32 and 34 are adapted to mate in a conventional manner.

The lid 22 includes an internal bore defined by an internal flange 40. An insulating plate 42 is supported on the internal flange and has a lower surface 43. A negative contact ring 44 is glued or otherwise attached to the lower surface 43 of the insulating plate 42, and a positive contact 45 is preferably glued to the lower surface 43 at a central position as shown. The lid further supports a circuit board 46 upon which a light sensor circuit is mounted. Both contacts 44 and 45 are connected to the circuit board 46 through wires that go through holes in the insulating plate. The negative contact ring 44 is of course connectable to the wire 28 running from bottom to top along the side of the hollow cylinder when the lid and casing are secured together. This completes the electrical circuit between the battery and the light sensor circuit.

The light element 14 also includes the light source or LED 47 wired to the sensor circuit. A cap 49 completes the assembly.

Figure 3:
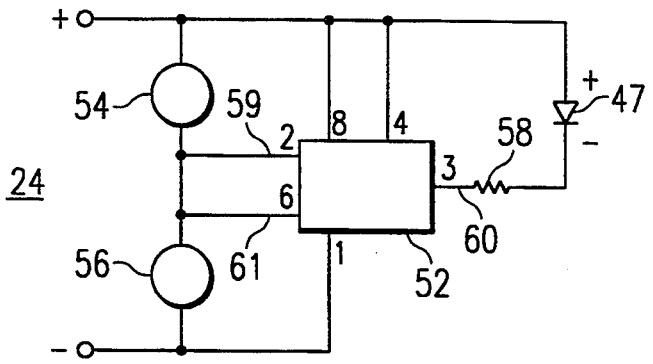
FIG. 3 is a detailed schematic diagram of the light sensor circuit of the light element of FIG. 2.

With reference now to FIG. 3, preferably the light sensor circuit 50 comprises a control switch 52, a pair of photocells 54 and 56, and a resistor 58. Battery 24 is connected across the terminals substantially as shown and supplies power to activate the switch 52 and thus activate a light emitting diode ("LED") element that generates visible light. The switch is preferably a conventional 555 integrated circuit element having its trigger and threshold inputs connected to the photocells 54 and 56 (via lines 59 and 61), and its output terminal connected to the resistor 58 (via line 60). Although not meant to be limiting, preferably the photocell 54 is responsive to red light and is used as an "on" device; photocell 56 is responsive to green light and is used as an "off" device. Of course, other frequencies can be used. When red light contacts the circuit 50 and the 555 timer is in a high state (which will occur when the battery is charged), a positive input pulse from photocell 54 will switch the timer to a low state. This will cause current to flow directly to the LED which would cause the light to turn on. If, however, the timer output was already in a low state (because the LED was previously activated), the LED would remain lighted if a red light was received or continues to be received by the photocell 54. Once a green light is received by the photocell 56, however, a positive input pulse from the photocell 56 will turn the timer back to the high state, thereby deactivating the LED.

The 555 element 52 thus acts as a bistable switch. A bistable switch is turned on and off with two different input signals; one for 'on' and one for 'off'. The bistable switch is preferable because it enables the light elements to be lit in a cascaded fashion. In particular, as one light element is lit, its LED generates a red light output which can then trigger ,the next light element in the chain, and so forth. Moreover, the bistable switch prevents lights from being turned on and then quickly off again by a signal meant only to turn the lights on.

In operation, light striking one of the photocells switches the 555 IC from a high state (off position) to a low state (on position), or vice versa. If off initially, light striking the first photocell 54 causes a positive input pulse that switches the timer on, sending current through both the resistor and the LED. Similarly, if the timer is on initially, light striking the photocell 56 will turn the 555 IC off. Because both photocells 54 and 56 are normally identical and will be exposed to the same lighting, they are preferably made to respond to different light by having different colored lenses. For example, photocell 54 has a red lens and photocell 56 has a green lens. The lenses act as filters, allowing only light of the same color to get through. Red and green are complimentary colors, so that if a green lens was placed over a red lens, no light would pass through both lenses. By shining a red light (wavelength=6200–7700 Angstroms) on both photocells 54 and 56, only photocell 54, having a red lens, is activated, switching the 55 IC on. Similarly, shining a green light (wavelength =5000–5800 Angstroms) on both photocells turns the circuit off.

Preferably, the photocells are made to respond only to light having an intensity of at least 6000 millicandles (mcd). This prevents the 555 IC from being switched on and off by other, less intense sources of red or green light, such as the Christmas tree lights themselves.

The battery 24 is preferably a single size AA lithium thionyl chloride battery which is used to power both the switching circuit and the LED in each light element 14. The lithium battery exhibits high voltage and energy capacity. This higher voltage allows the use of only one battery per light unit. A high energy capacity is desired so that a battery will provide its light unit with energy for a long period of time.

Alternatively, two size N alkaline batteries in series can be used as the power source for each light element, rather than the single size AA lithium battery. In either case, preferably each lighting element will be supportable in a recharging unit 11 as shown in FIG. 1 that also is used to store the light elements 14 when the system is not in use.

Figure 4:
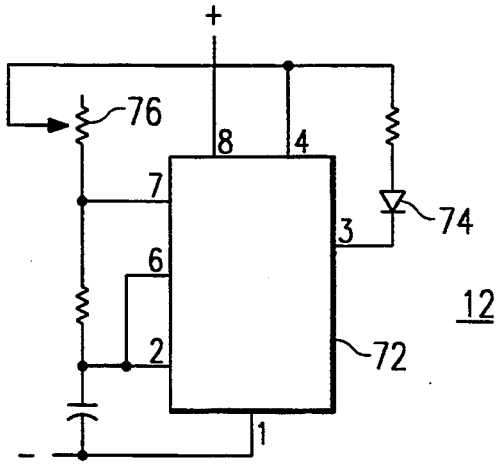
FIG. 4 is a detailed schematic diagram of a transmitter control unit of the cordless tree lighting system of FIG. 1.

Referring now to FIG. 4, a schematic diagram is shown of a preferred control transmitter 12 for use in the invention. The transmitter 12 uses a 555 timing circuit 72 to activate a red LED 74 as the transmitter "on" light source. A potentiometer 76 adjusts the sensitivity of the 555 timer. The transmitter 12 will include a similar circuit for activating the green LED to generate the "off" signal.

Figure 5:
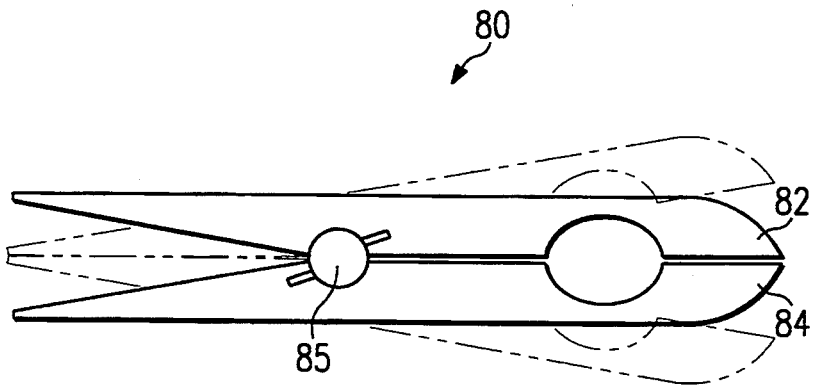
FIG. 5 is a view of a preferred clamp useful in attaching a light element to a tree.

Referring now to FIG. 5, a tree clamp 80 for use in supporting one of the light elements 14 is shown. The clamp comprises first and second arms 82 and 84 that are joined together by a spring 85. One of the arms is glued or otherwise secured to the dish upon which the casing 20 is secured. By pinching the ends of the arms together, the clamp opens as shown.

The present invention solves the problems associated with the prior art. In particular, aesthetic problems caused by use of cord-based systems are eliminated. The individual light elements are easy to locate in desired places upon the Christmas tree. The light elements are easy to turn on and off, and they are provided in a simple structural housing that does not interfere with the aesthetics of the tree or the ornaments supported thereon. With the novel design provided, the light elements can expect to offer at least 100 hours of operation with minimum maintenance (i.e., no replacement of batteries). The system is safe to install and operate, and quite easy to store. Because light emitting diode elements are used in the light elements, the lights do not emit excessive heat, and the system does not require excessive current. The entire system is thus quite safe and reliable.

Preferably, each of the individual lighting elements can be housed (during periods of non-use) on a rechargeable board. In such case, casing 20 of FIG. 2 will include appropriate electrodes on the bottom 25 thereof which will be received in the board (not shown). The electrodes are attached to the anode and cathode of the battery as is well known in the prior art. The use of a rechargeable board provides significant advantages and enables the individual units to be reused. Of course, any suitable type of battery may be used to power the individual light units including AAA or conventional lithium batteries. Moreover, one or more of the individual units can be adapted or designed with any motif including stars, balls, candles, ornaments, etc. Individual units may be hung as opposed to clamped onto the tree limbs.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. A cordless lighting system for a decorative tree, comprising:

a control transmitter for generating light signals of first and second frequencies;

a plurality of light elements, each of the light elements comprising:

a light source for generating visible light of the first frequency;

a battery for supplying power to activate the light source;

a bistable switch having an input, and an output connected to the light source;

first and second photocells, each photocell having a colored lens such that the lens of the first photocell causes the first photocell to respond to light signals of the first frequency and the lens of the second photocell causes the second photocell to respond to light Signals of the second frequency, thereby generating first and second control signals to the input of the bistable switch, wherein the first control signal controls the bistable switch to activate the light source for generating visible light of the first frequency and the second control signal controls the bistable switch to deactivate the light source; and a plurality of clamps, each of the clamps for attaching a light element to the tree;

wherein upon activation of the light source of a first light element, light of the first frequency is received by the first photocell of a second light element to thereby activate the light source of the second light element such that the first and second light elements are lit in a cascaded manner.

2. The cordless lighting system as described in claim 1 wherein the visible light is of the first frequency.

3. The cordless lighting system as described in claim 2 wherein the first photocell of at least one of the light elements is responsive to the visible light generated by the light source of a light element supported nearby on the decorative tree such that the light elements are activated in a cascade fashion.

4. The cordless lighting system as described in claim 1 wherein the light source in the light element is a light emitting diode.

5. The cordless lighting system as described in claim 1 wherein the light element is supported in a simulated candle.

6. The cordless lighting system as described in claim 1 further including a recharging unit for storing and recharging the batteries of the light elements.

7. A light element adapted for support on a decorative tree having a plurality of such elements, comprising:

a light source for generating visible light of the first frequency;

a battery for supplying power to activate the light source;

a bistable switch having an input, and an output connected to the light source; and first and second photocells, each photocell having a different colored lens such that the lens of the first photocell causes the first photocell to respond to light signals of the first frequency and the lens of the second photocell causes the second photocell to respond to light signals of the second frequency, thereby generating first and second control signals to the input of the bistable switch, wherein the first control signal controls the bistable switch to activate the light source for generating visible light of the first frequency and the second control signal controls the bistable switch to deactivate the light source.

* * * * *